US008506329B2

(12) United States Patent
Bonner

(10) Patent No.: US 8,506,329 B2
(45) Date of Patent: Aug. 13, 2013

(54) METHOD AND SYSTEM FOR A CONNECTOR ALIGNMENT INSERT

(75) Inventor: Carl Evans Bonner, Grand Rapids, MI (US)

(73) Assignee: GE Aviation Systems, LLC, Grand Rapids, MI (US)

( * ) Notice: Subject to any disclaimer, the term of this patent is extended or adjusted under 35 U.S.C. 154(b) by 305 days.

(21) Appl. No.: 12/872,612

(22) Filed: Aug. 31, 2010

(65) Prior Publication Data

US 2012/0052740 A1 Mar. 1, 2012

(51) Int. Cl.
*H01R 13/40* (2006.01)

(52) U.S. Cl.
USPC ..... 439/599; 439/703; 439/274

(58) Field of Classification Search
USPC ..... 439/447, 274, 277, 598, 599, 703
See application file for complete search history.

(56) References Cited

U.S. PATENT DOCUMENTS

| | | | | |
|---|---|---|---|---|
| 3,402,382 | A * | 9/1968 | De Tar | 439/469 |
| 3,778,750 | A * | 12/1973 | Caveney et al. | 439/392 |
| 4,601,530 | A * | 7/1986 | Coldren et al. | 439/460 |
| 4,655,525 | A * | 4/1987 | Hunt et al. | 439/599 |
| 4,898,548 | A * | 2/1990 | Case et al. | 439/686 |
| 4,902,092 | A * | 2/1990 | Grandy | 385/56 |
| 5,295,842 | A * | 3/1994 | Ozaki et al. | 439/76.2 |
| 5,423,692 | A | 6/1995 | Francis | |
| 5,573,430 | A * | 11/1996 | Hatagishi | 439/701 |
| 5,685,730 | A | 11/1997 | Cameron et al. | |
| 6,309,231 | B1 | 10/2001 | Gordon et al. | |
| 6,439,929 | B1 * | 8/2002 | Jenets | 439/607.51 |
| 6,764,350 | B2 * | 7/2004 | Kosmala | 439/752 |
| 6,874,946 | B2 * | 4/2005 | Cull | 385/71 |
| 7,044,789 | B2 * | 5/2006 | Yohn et al. | 439/599 |
| 7,186,144 | B1 | 3/2007 | Khemakhem et al. | |
| 7,322,859 | B2 | 1/2008 | Evans | |
| 7,458,855 | B2 | 12/2008 | Khemakhem et al. | |
| 7,726,999 | B2 | 6/2010 | Vanzo | |
| 7,942,588 | B2 * | 5/2011 | Durand et al. | 385/77 |
| 2009/0237258 | A1 * | 9/2009 | Heck et al. | 340/585 |
| 2012/0052740 | A1 * | 3/2012 | Bonner | 439/660 |

* cited by examiner

*Primary Examiner* — James Harvey
(74) *Attorney, Agent, or Firm* — David J. Clement; Armstrong Teasdale LLP

(57) ABSTRACT

A method assembling a cable connector system and an alignment insert are provided. The alignment insert includes a body having a first planar surface, a second planar surface, and a thickness extending therebetween. The body includes an outer peripheral surface sized complementarily to an inner surface of a first connector portion and further including one or more slots therethrough and extending from the outer peripheral surface inwardly a first predetermined distance. A first width of each of the one or more slots and the predetermined distance based on an orientation of a connector pin positioned within the first connector portion.

7 Claims, 5 Drawing Sheets

METHOD AND SYSTEM FOR A CONNECTOR ALIGNMENT INSERT

BACKGROUND OF THE INVENTION

The field of the invention relates generally to cable connectors, and more specifically, to a method and system for assembling a cable connector.

In electrical wiring where a number of wires terminate at a pinboard or at the separable halves of a connector, it has been convenient to employ push-pin assemblies that afford a high degree of convenience in a space-saving manner. The push-pins are mechanically and/or electrically joined to the ends of the wires and such pins are then inserted into respective holes in the pinboard or connector member, where they become locked in place by virtue of spring-like locking members affiliated with the pins and locking shoulders formed in the holes into which such pins are inserted. In the case of connectors, the pin-receiving holes extend through the connector members and the push-pins of the one half, the male-half, project beyond the joining face, while the push-pins of the other half, female are hollow-ended and terminate near the respective joining face for receiving the male-half pins, respectively.

Several styles of round MIL connectors have large diameter coax and triax pins that can be pushed out of alignment by the cable clamp. Such misalignment can affect the performance of the connector and cable attached thereto, for example, when the insert is cracked or broken by stresses imparted to the insert. This has caused instances in which the entire connector had to be replaced on a test equipment cable. As this connector mates with the product, there is the possibility that the damaged connector could cause damage to the product before the failure was noticed.

BRIEF DESCRIPTION OF THE INVENTION

In one embodiment, an alignment insert includes a body having a first planar surface, a second planar surface, and a thickness extending therebetween. The body includes an outer peripheral surface sized complementarily to an inner surface of a first connector portion and further including one or more slots therethrough and extending from the outer peripheral surface inwardly a first predetermined distance. A first width of each of the one or more slots and the predetermined distance based on an orientation of a connector pin positioned within the first connector portion.

In another embodiment, a method of assembling a cable connector includes inserting one or more connector pins through a shell insert of a connector shell and sliding a first alignment insert between at least a portion of the one or more connector pins, the alignment insert including a body having a first planar surface, a second planar surface, and a thickness extending therebetween, the body including an outer peripheral surface sized complementarily to an inner surface of the connector shell, the body further including one or more slots therethrough and extending from the outer peripheral surface inwardly a first predetermined distance, a first width of each of the one or more slots and the predetermined distance based on an orientation of the one or more inserted connector pins positioned within the shell insert. The method also includes clamping a backshell of the cable connector to a cable having at least one conduit communicatively coupled to a respective one of the one or more connector pins such that a radial force imparted to the one or more connector pins by the clamping.

In yet another embodiment, a cable connector includes a connector shell including a shell insert having one or more connector pins extending therethrough and a first alignment insert positioned between at least a portion of the one or more connector pins, the alignment insert including a body having a first planar surface, a second planar surface, and a thickness extending therebetween, the body including an outer peripheral surface sized complementarily to an inner surface of the connector shell, the body further including one or more slots therethrough and extending from the outer peripheral surface inwardly a first predetermined distance, a first width of each of the one or more slots and the predetermined distance based on an orientation of the one or more inserted connector pins positioned within the shell insert. The cable connector also includes a backshell that is configured to be coupled to the connector shell and to a cable extending from the one or more connector pins through the backshell.

BRIEF DESCRIPTION OF THE DRAWINGS

FIG. 1 is an exploded view of a plug connector that may be used with embodiments of the present invention;

FIG. 2 is an end view of the back side of shell shown in FIG. 1;

FIG. 3 is a perspective view of an alignment insert in accordance with an exemplary embodiment of the present invention;

FIG. 4 is a perspective view of an alignment insert in accordance with another exemplary embodiment of the present invention; and FIG. 5 is a perspective view of an alignment insert in accordance with yet another exemplary embodiment of the present invention.

DETAILED DESCRIPTION OF THE INVENTION

The following detailed description illustrates embodiments of the invention by way of example and not by way of limitation. It is contemplated that the invention has general application to assembling a cable connector in industrial, commercial, and residential applications.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Figure 1:
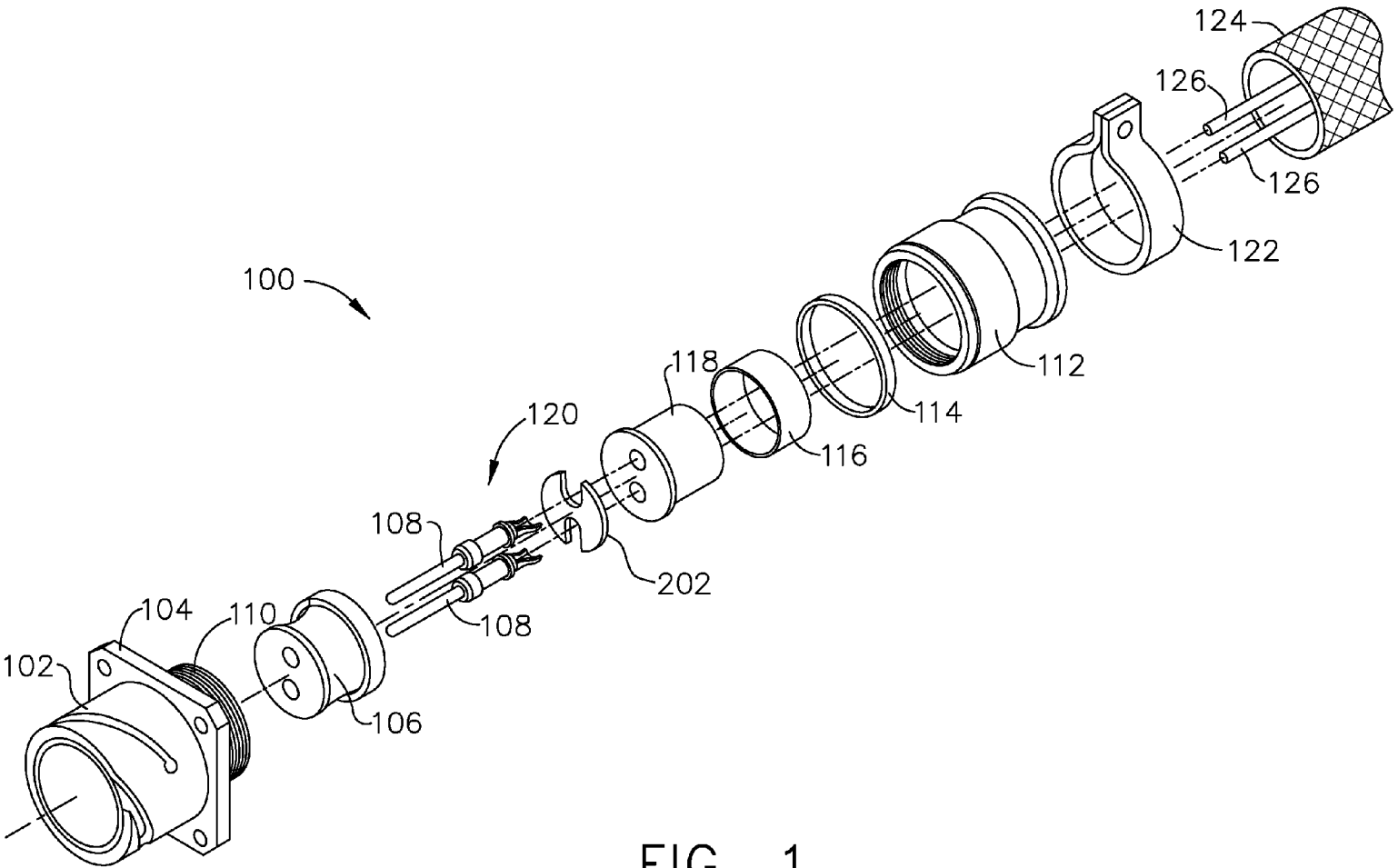
FIGS. 1-5 show exemplary embodiments of the method and system described herein.

FIG. 1 is an exploded view of a plug connector 100 that may be used with embodiments of the present invention. In the exemplary embodiment, connector 100 includes a connector shell 102 having a mounting flange 104 and a shell insert 106 having one or more connector pins 108 extending therethrough. A coupling connection 110 permits coupling a backshell 112 to connector 100. Backshell 112 may also include a sealing ring 114, a compression ring 116, and a grommet 118 to facilitate sealing a pin area 120 from foreign material intrusion. Backshell 112 is configured to be coupled to connector shell 102 using coupling connection 110 and to a cable 124 extending from one or more connector pins 108 through backshell 112 using a clamp 122. Clamp 122 is configured to restrain movement of the cable 124 with respect to backshell 112.

Figure 2:
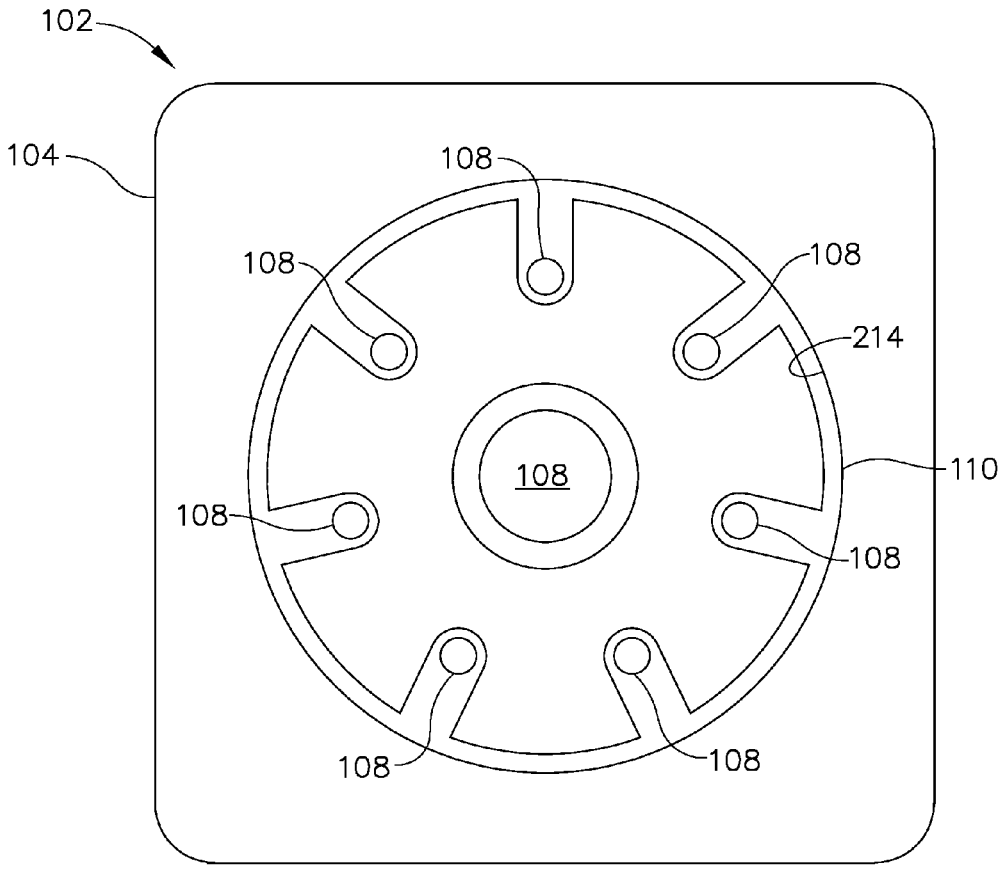

FIG. 2 is an end view of the back side of connector shell 102 (shown in FIG. 1). As shown in FIG. 1, when partially assembled, connector shell 102 includes mounting flange 104 and shell insert 106 having one or more connector pins 108 extending therethrough. Connector shell 102 also includes an inner surface 214. Coupling connection 110 permits coupling backshell 112 to connector shell 102. A first alignment insert 202 is positioned between at least a portion of the one or more connector pins 108. An alignment insert 202 maintains a spacing and alignment of pins 108 during assembly and manipulation of connector shell 102 during use.

Figure 3:
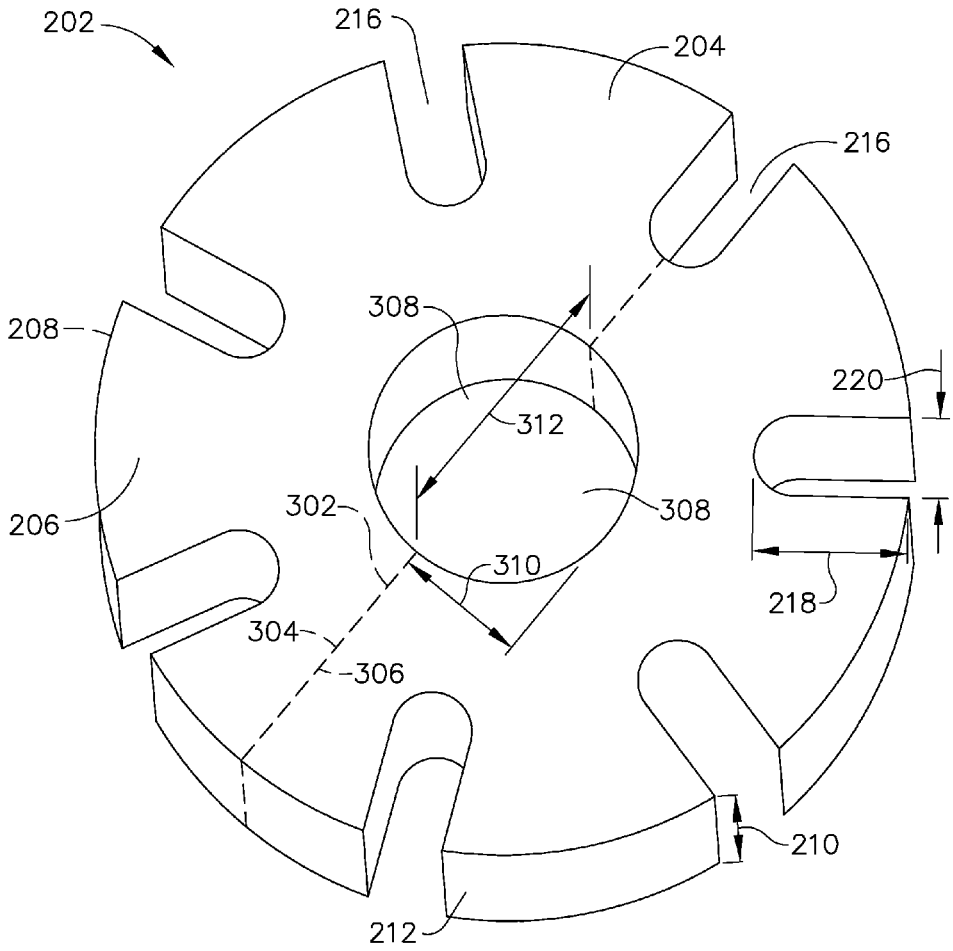

FIG. 3 is a perspective view of alignment insert 202 in accordance with an exemplary embodiment of the present invention. Alignment insert 202 is configured to maintain a parallel alignment of one or more connector pins 108 when clamp 122 is engaged with the cable 124. Alignment insert 202 includes a body 204 having a first planar surface 206, a second planar surface 208, and a thickness 210 extending therebetween. Body 204 also includes an outer peripheral surface 212 sized complementarily to inner surface 214 (shown in FIG. 2). Body 204 further includes one or more slots 216 therethrough and extending from outer peripheral surface 212 inwardly a first predetermined distance 218, a first width 220 of each of one or more slots 216 and predetermined distance 218 based on an orientation of one or more inserted connector pins 108 positioned within shell insert 106. In one embodiment, alignment insert 202 includes an aperture through a center of alignment insert 202. In the exemplary embodiment, alignment insert 202 is formed as a unitary member.

In various other embodiments, alignment insert 202 is formed from a plurality of pieces fitting together along respective joints 302 formed at complementary surfaces 304 and 306. Alignment insert 202 may include one or more slots 308 therethrough and extending from said complementary surfaces 304 and 306 of the respective joint 302 inwardly. A predetermined distance 310 and a width 312 of each of the one or more slots 308 is determined based on an orientation of a connector pin (not shown in FIG. 3) positioned within shell insert 106. When alignment insert 202 is formed of a unitary piece an aperture may be defined in an interior of alignment insert 202. When alignment insert 202 is formed of more than one piece slots extending from the abutting surfaces of the more than one pieces may be used to accommodate additional pins and conduits.

In the exemplary embodiment, alignment insert 202 is formed of plastic, however any other nonconductive material may be used. Alignment insert 202 functions to hold wires 126 or other conduit, for example, but not limited to, fiber cable, in alignment with pins 108, keeping pins 108 parallel with respect to each other and orthogonal with respect to a face of shell insert 106, so that pins 108 engage with the mating connectors in the other half of connector 100 with minimum force. Alignment insert 202 is installed in the connector backshell and maintains the cabling attached to the large diameter pins in fixed alignment in relation to the connector pins.

Figure 4:
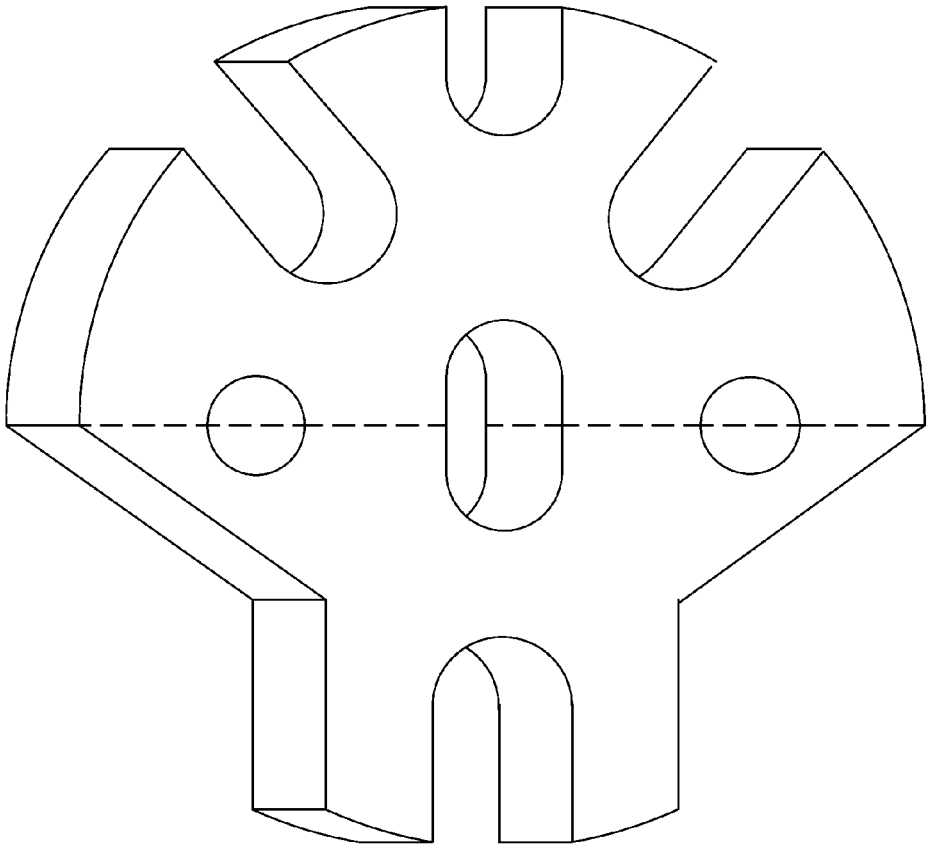

FIG. 4 is a perspective view of an alignment insert 402 in accordance with another exemplary embodiment of the present invention. In the exemplary embodiment, alignment insert 402 is reduced in size to reduce unneeded material in an area where no pins exist making fabrication of alignment insert 402 less costly. Alignment insert 402 may also be fabricated of any shape to accommodate different connector configurations. Additionally, the cutout areas may assist in manually handling alignment insert 402 to ease installation effort.

Figure 5:
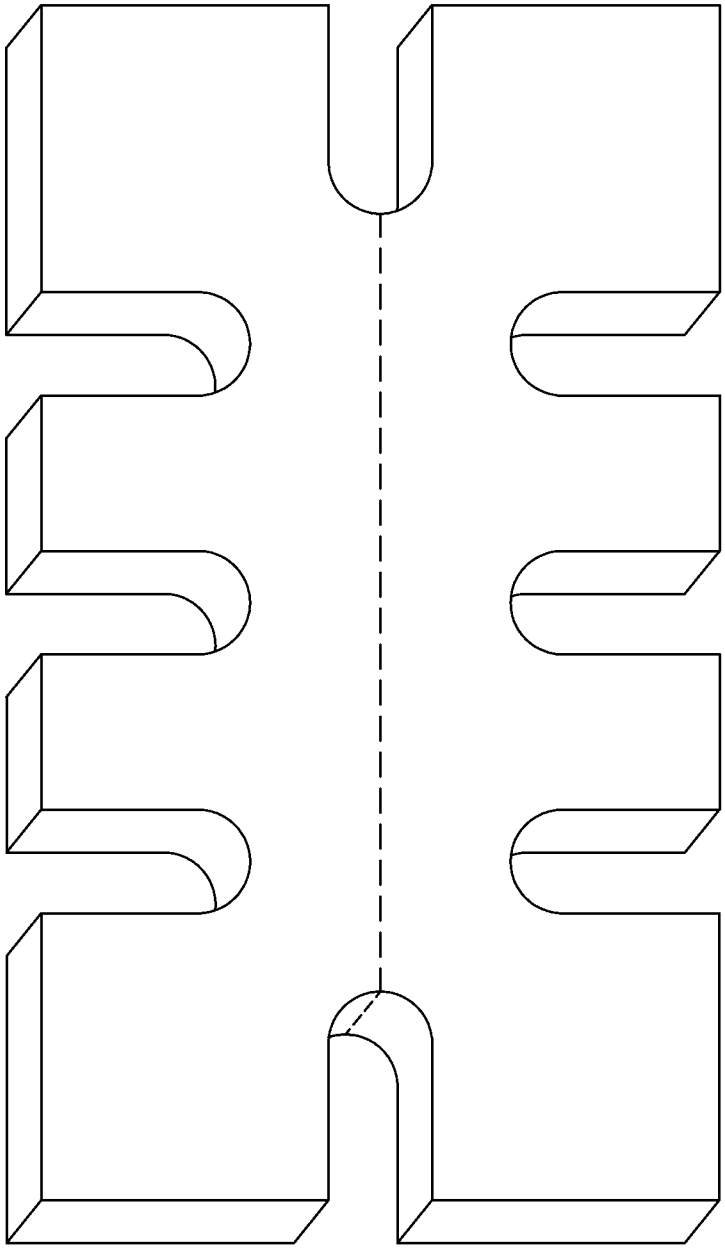

FIG. 5 is a perspective view of an alignment insert 502 in accordance with yet another exemplary embodiment of the present invention. In the exemplary embodiment, alignment insert 402 is rectangularly-shaped to match a configuration of a connector shell, backshell, and pin configuration. Alignment insert 402 may also be fabricated of any other shape to accommodate different connector configurations.

The above-described embodiments of a method and system of assembling a cable connector provides a cost-effective and reliable means for reducing the possibility of the test equipment connector damaging the product connectors. More specifically, the methods and systems described herein facilitate replacing contact pins and connectors less often. As a result, the method and system described herein facilitate maintaining electrical and electronic equipment in a cost-effective and reliable manner.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A method of assembling a cable connector, said method comprising:

inserting one or more connector pins through a shell insert of a connector shell;

sliding a first alignment insert between at least a portion of the one or more connector pins, the alignment insert comprising a body having a first planar surface, a second planar surface, and a thickness extending therebetween, the body comprising an outer peripheral surface sized complementarily to an inner surface of the connector shell, the body further comprising one or more slots therethrough and extending from the outer peripheral surface inwardly a first predetermined distance, a first width of each of the one or more slots and the first predetermined distance based on an orientation of the one or more inserted connector pins positioned within the shell insert;

positioning the first alignment insert between the shell insert and a grommet of the backshell;

sliding a second alignment insert between a remaining portion of the one or more connector pins; and clamping a backshell of the cable connector to a cable having at least one conduit communicatively coupled to a respective one of the one or more connector pins.

2. A method in accordance with claim 1, wherein at least one surface of said first alignment insert and said second alignment insert abut along complementary surfaces.

3. A cable connector system comprising:

a connector shell comprising a shell insert having one or more connector pins extending therethrough;

a first alignment insert positioned between at least a portion of the one or more connector pins, and between the shell insert and a grommet of the backshell, the alignment insert comprising a body having a first planar surface, a second planar surface, and a thickness extending therebetween, the body comprising an outer peripheral surface sized complementarily to an inner surface of the connector shell, the body further comprising one or more slots therethrough and extending from the outer peripheral surface inwardly a first predetermined distance, a first width of each of the one or more slots and the predetermined distance based on an orientation of the one or more inserted connector pins positioned within the shell insert, the body further comprising an aperture through a center of said body; and a backshell of the cable connector configured to be coupled to said connector shell and to a cable extending from the one or more connector pins through the backshell, said backshell comprising a clamp configured to restrain movement of the cable with respect to the backshell.

4. A first alignment insert in accordance with claim 3, wherein each of the thickness of said first alignment insert, the first predetermined distance, and the first width of each of the one or more slots are selected such that said first alignment insert is configured to maintain a parallel alignment of one or more connector pins when the clamp is engaged with the cable.

5. A first alignment insert in accordance with claim 3, wherein said body is formed as a unitary member.

6. A first alignment insert in accordance with claim 3, wherein said body is formed from a plurality of pieces fitting together along respective joints formed at complementary surfaces.

7. A first alignment insert in accordance with claim 6, further comprising one or more complementary surface slots therethrough and extending from said complementary surfaces of said respective joints towards the outer peripheral surface a second predetermined distance, a second width of each of the one or more slots and the second predetermined distance based on an orientation of a connector pin positioned within the connector shell.

* * * * *

UNITED STATES PATENT AND TRADEMARK OFFICE

CERTIFICATE OF CORRECTION

PATENT NO. : 8,506,329 B2
APPLICATION NO. : 12/872612
DATED : August 13, 2013
INVENTOR(S) : Bonner It is certified that error appears in the above-identified patent and that said Letters Patent is hereby corrected as shown below:

Claims

In Claim 7, column 5, line 25, delete "joints towards" and insert therefore -- joints inwardly towards --.

Signed and Sealed this
Sixteenth Day of August, 2016

Michelle K. Lee

Michelle K. Lee
*Director of the United States Patent and Trademark Office*